US007497424B2

(12) United States Patent
Nakajima et al.

(10) Patent No.: US 7,497,424 B2
(45) Date of Patent: Mar. 3, 2009

(54) IMAGE FORMING APPARATUS AND BOOKBINDING SYSTEM

(75) Inventors: Hirofumi Nakajima, Hachioji (JP); Teruhiko Toyoizumi, Tachikawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 211 days.

(21) Appl. No.: 11/488,086

(22) Filed: Jul. 18, 2006

(65) Prior Publication Data

US 2007/0120311 A1 May 31, 2007

(30) Foreign Application Priority Data

Nov. 29, 2005 (JP) ..... 2005-343453

(51) Int. Cl.
*B65H 37/04* (2006.01)

(52) U.S. Cl. ..... 270/12; 270/1.01; 270/58.07; 270/58.08; 270/58.01; 399/362; 399/407; 399/408; 399/410

(58) Field of Classification Search ..... 270/1.01, 270/12, 58.01, 58.07, 58.08; 399/362, 407, 399/408, 410

See application file for complete search history.

(56) References Cited

U.S. PATENT DOCUMENTS 7,263,328 B2 * 8/2007 Asai et al. ..... 399/408
2004/0177336 A1 * 9/2004 Kujirai ..... 717/104
2005/0232656 A1 * 10/2005 Asai et al. ..... 399/130
2008/0049247 A1 * 2/2008 Asai et al. ..... 358/1.15
2008/0186535 A1 * 8/2008 Maeda et al. ..... 358/1.15

FOREIGN PATENT DOCUMENTS

JP 2001-205857 7/2001
JP 2004-209869 7/2004

* cited by examiner

*Primary Examiner*—Gene Crawford
*Assistant Examiner*—Leslie A Nicholson, III
(74) *Attorney, Agent, or Firm*—Finnegan, Henderson, Farabow, Garrett & Dunner, L.L.P.

(57) ABSTRACT

An image forming apparatus that forms an image on a sheet includes a reading unit that reads a plurality of original document sheets, a supply unit that supplies a sheet for a cover and a sheet for an inner page, a designating unit for designating an arbitrary one from original document sheets read by the reading unit, an image forming unit that forms an image based on information on a read original document, and a control unit that controls selection of a sheet, wherein, the control unit performs control to supply a sheet for a cover from the supply unit when an image is formed based on an original document sheet designated by the designating unit, and to supply a sheet for an inner page from the supply unit when an image is formed based on an original document sheet not designated by the designating unit.

11 Claims, 3 Drawing Sheets

IMAGE FORMING APPARATUS AND BOOKBINDING SYSTEM

This application is based on Japanese Patent Applications No. 2005-343453 filed on Nov. 29, 2005 in Japanese Patent Office, the entire content of which is hereby incorporated by reference.

FIELD OF THE INVENTION

The present invention relates to an image forming apparatus, and relates to a book binding system having an image forming apparatus and a bookbinding apparatus connected with each other to bind a book.

In recent years, there are provided bookbinding devices having a plurality of means for post-processing of sheets on which an image has been recorded by an image forming device, such a copier, printer, or multi functional machine of such devices. An example of such post-processing is binding sheets with stapling means, and another example is wrap-bookbinding by applying adhesive on one edge surface of a bundle of sheets to stick a cover onto this edge surface and wrapping the bundle of sheets with the cover.

Further, there is printed a title or the like on the cover of a bound book in order to show the content of the book. Herein, methods are widely adopted in which a cover is conveyed from a cover supply unit to a bookbinding unit in a bookbinding apparatus (for example, see TOKKAI No. 2004-209869).

Still further, a system is disclosed in TOKKAI NO. 2001-205857 that includes a printing unit for printing on a cover and automatically creates and prints a cover including the front cover, spine cover, and back cover, at the time of document printing.

However, since an image forming system disclosed in TOKKAI No. 2004-209869 cannot perform printing on a cover having been set in a cover supply unit, it is necessary to set a cover on which printing has been performed in advance. Further, unlike the case of document printing in which created documents are registered and output, in the case of reading image information of original document sheets fed out from an automatic original document feeder in a process of wrap-bookbinding, the image forming system disclosed in TOKKAI No. 2001-205857 reads image information twice separately, that is, from original document sheets for images to be formed on a bundle of sheets which will be wrapped in a cover and from original document sheets for images to be formed on the cover.

With this background, an object of the present invention is to provide an image forming apparatus that forms images respectively on a bundle of sheets and a cover, even if image information is read only once without distinguishing between original document sheets with images to be formed on the bundle of sheets which will be wrapped in a cover and original document sheets with images to be formed on the cover.

SUMMARY OF THE INVENTION

The present invention includes the following structures.

(Item 1)

An image forming apparatus that forms an image on a sheet, comprising:

a reading unit that reads a plurality of original document sheets;

a supply unit that supplies a sheet for a cover and a sheet for an inner page;

a designating unit for designating an arbitrary one from original document sheets read by the reading unit;

an image forming unit that forms an image based on information on a read original document; and a control unit that controls selection of a sheet, wherein, the control unit performs control to supply a sheet for a cover from the supply unit when an image is formed based on an original document sheet designated by the designating unit, and to supply a sheet for an inner page from the supply unit when an image is formed based on an original document sheet not designated by the designating unit.

(Item 2)

A bookbinding system, comprising:

an image forming apparatus including a reading unit that reads a plurality of original document sheets and an image forming unit that forms an image on a sheet based on information on a read original document sheet;

a bookbinding apparatus that binds sheets on which an image has been formed by the image forming apparatus into a book;

a supply unit that supplies a sheet for a cover and a sheet for an inner page;

a designating unit for designating an arbitrary one from original document sheets read by the reading unit; and a control unit that controls selection of a sheet, wherein, the control unit performs control to select a sheet for a cover from the supply unit when an image is formed based on an original document sheet designated by the designating unit, and to select a sheet for an inner page from the supply unit when an image is formed based on an original document sheet not designated by the designating unit.

(Item 3)

An image forming method, comprising the steps of:

reading a plurality of original document sheets;

designating an arbitrary original document sheet from the read original document sheets;

supplying a sheet for a cover, when an image is formed based on a designated original document sheet;

supplying a sheet for an inner page, when an image is formed based on an original document sheet that is not designated; and forming an image on a supplied sheet based on an original document sheet having been read.

DETAILED DESCRIPTION OF PREFERRED EMBODIMENT

Figure 1:
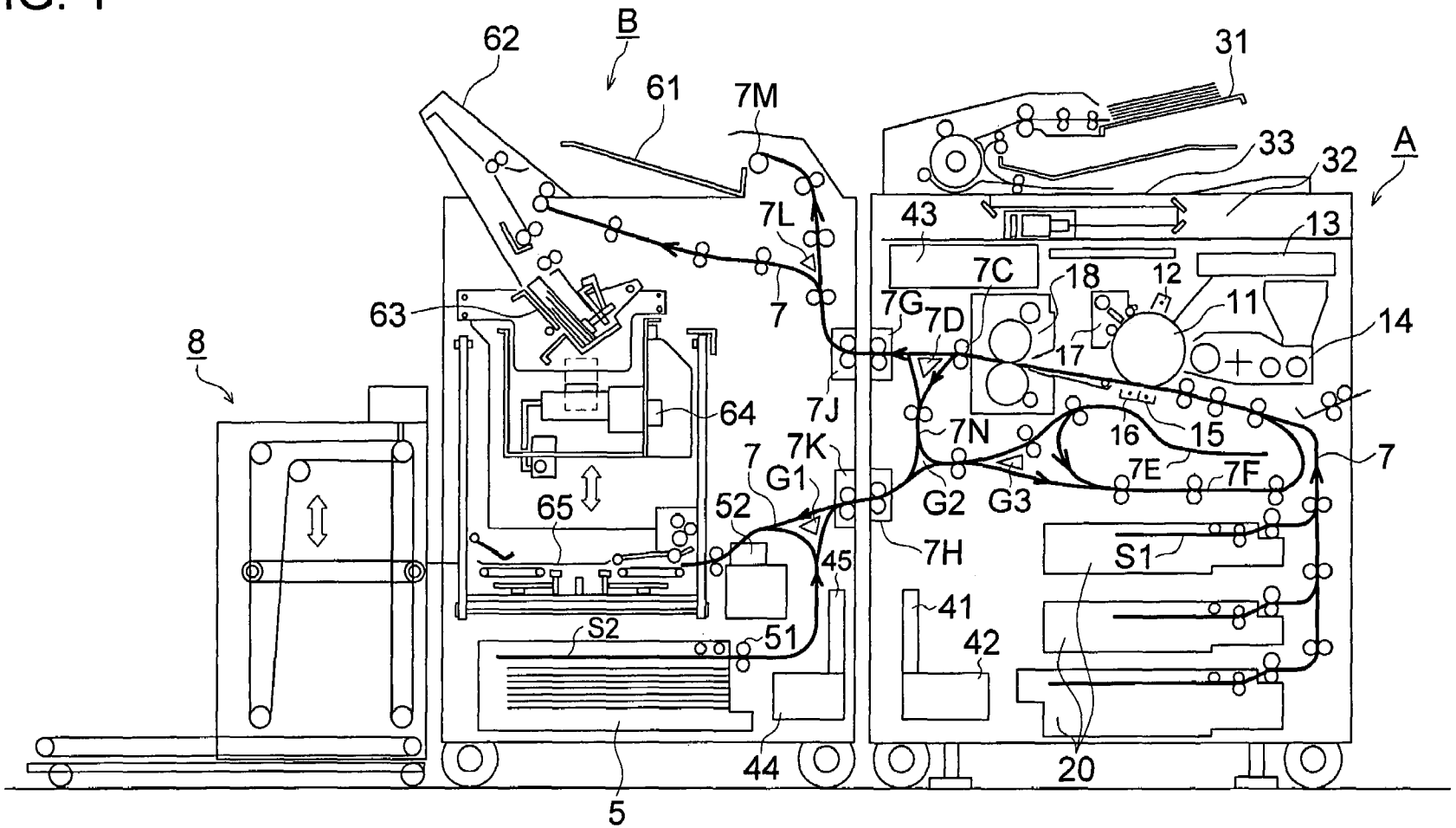
FIG. 1 is an entire structural view of a bookbinding system provided with an image forming apparatus A and a bookbinding apparatus B, in accordance with an embodiment of the invention.

Now, an image forming apparatus, bookbinding apparatus, and bookbinding system in an embodiment in accordance with the invention will be described, referring to the drawings.

(Image Forming Apparatus A)

FIG. 1 is an entire structural view of a bookbinding system having an image forming apparatus A and bookbinding apparatus B.

The image forming apparatus A has an image forming unit provided with a charging unit 12, image exposing unit 13, developing unit 14, transferring unit 15, neutralizing unit 16, and cleaning unit 17 which are disposed around a rotating image carrier 11. In the image forming unit, the charging unit 12 uniformly charges the surface of the image carrier 11, then a latent image is formed through exposure scanning, based on image data having been read from an original document sheet by a laser beam from the image exposing unit 13, and forms a toner image on the surface of the image carrier 11 by reversely developing the latent image with the developing unit 14. Herein, the image data may be received image information that is generated by an image data generating unit as an external device, such as a personal computer PC (also referred to as PC), and then received.

In the following description, sheets to be used for inner pages (namely, inner pages of a book other than the inside front cover or the inside back cover) is referred to as sheets S1, and a sheet to be used for a cover is referred to as a sheet S2.

A sheet S1 having been supplied from a sheet S1 supply unit 20 (supply unit) is conveyed to a transfer position. The toner image, described above, is transferred to the sheet S1 by the transferring unit 15 at the transfer position. Thereafter, the back side of the sheet S1 is electrically neutralized by the neutralizing unit 16 and the sheet S1 is separated from the image carrier 11 and conveyed by a conveying unit 7. Subsequently, the image is fixed with heat by a fixing unit 18. Then, the sheet S1 is ejected from ejecting rollers 7*c*, conveyed to a first ejection opening 7G guided by a conveying-path switching plate 7D, and fed out to the bookbinding apparatus B.

In the case of forming images on both sides of a sheet S1, the sheet S1 having been subjected to heat-fixing by the fixing unit 18 branches from the normal ejecting path, guided by the conveying-path switching plate 7D, and gets switched back by a reverse conveying unit 7E to be reversed in terms of front and back sides. Then, the sheet S1 passes through the image forming unit again so that an image is formed on the back side of the sheet S1, passes through the fixing unit 18, ejection rollers 7C and first ejection opening 7G, and is fed out to the bookbinding apparatus B.

An original document sheet conveying device 31 conveys original document sheets one by one to the reading position. An original document sheet reading unit 32 reads the image on an original document sheet having been conveyed by the original document sheet conveying device 31 or loaded on a draft table 33 and generates an image signal.

A communication unit 42 communicates with a device on a network, receives an image forming instruction transmitted from the network, and generates an image signal as image information.

The surface of the image carrier 11 after image processing gets rid of a developing agent remaining on it by the cleaning unit 17 so as to be prepared for the next image forming.

A control unit 41 totally controls units, such as those of the image forming unit and conveying unit.

An operation unit 43 for designation is provided with a switch, a LCD display and others, not shown, and used for input of information on sheets, setting of the positions of original document sheets for a cover in accordance with the present embodiment, and the like.

Further, the image forming apparatus A includes a second ejection opening 7H that receives a sheet S2 having been conveyed from a sheet S2 supply unit 5 of the bookbinding apparatus B, described later, and ejects the sheet S2 back to the bookbinding apparatus B after the image forming unit in the image forming apparatus has formed an image on one side or both sides of the sheet S2.

Now, a bookbinding system in accordance with the present embodiment will be described based on a bookbinding apparatus B which uses an adhesive (also referred to as glue) for bookbinding, however, the invention is not limited to the present embodiment.

(Bookbinding Apparatus B)

The bookbinding apparatus B includes a sheet conveying paths through which a sheet S1 having been ejected from the first ejection opening 7G of the image forming apparatus A and having passed through a first receiving opening 7J is guided by a switching gate 7L provided in the middle part of a conveying unit 7, and either ejected onto an ejection plate 61 or conveyed to a sheet reversing unit 62 that switchbacks the sheet.

Further, the bookbinding apparatus B includes a stacking unit 63 on which to stack sheets S1 that are conveyed to the sheet reversing unit 62 when bookbinding is designated via the operation unit 43 or the like and then fed to the stacking unit 63 from the sheet reversing unit 62 one by one, a coating unit 64, a sheet S2 supply unit 5 that stores sheets S2, sheet feeding rollers 51, a cutter 52 for cutting a sheet S2 into a length corresponding to the bundle of sheets S1, a cover supporting unit 65 for supporting a cover, and a book ejection unit 8 on which to stack books produced by joining a cover and sheets.

When bookbinding is not designated via the operation unit or the like, sheets S1 are ejected to the ejection plate 61.

The communication unit 44 performs bookbinding with sheets and a cover formed with an image, upon instruction for bookbinding transmitted from the image forming apparatus A.

A control unit 45 totally controls units of the image forming unit, conveying unit and the like.

Now, cover-conveying paths in accordance with the present embodiment will be described.

The heavy curves in FIG. 1 show the cover-conveying paths and the arrows on the paths indicate the conveying directions.

A sheet S2 has four areas in terms of positions on a cover, namely, the outside front cover 1, inside front cover 2, inside back cover 3, and outside back cover 4. More details will be described later, referring to FIG. 3. Image forming is performed simultaneously on the outside front cover 1 and outside back cover 4, and simultaneously on the inside front cover 2 and inside back cover 3. That is, since the outside front cover 1 and outside back cover 4 are on the same side of the sheet, image forming on these areas is performed simultaneously. Likewise, since the inside front cover 2 and inside back cover 3 are on the same side of the sheet, image forming on these areas is performed simultaneously.

In the case of forming an image on a sheet S2, a sheet S2 stored in the sheet S2 supply unit 5 is fed out by the sheet feeding rollers 51, conveyed to the second ejection opening 7H of the image forming apparatus A through a second receiving opening 7K, guided by the switching gate G1, and then guided by the switching gate G2 to be conveyed either to the reverse conveying unit 7E with guidance by the switching gate G3 or to the conveying unit 7F without reversing.

In the case of forming images only on the outside front cover 1 and outside back cover 4, the sheet S2 is reversed in terms of front-and-back sides and conveyed to the conveying unit 7F. After images are formed on the outside front cover 1 and outside back cover 4 in the image forming unit, the images are heat-fixed by the fixing unit 18 and the sheet S2 is conveyed, through s conveying switching plate 7*d*, a front cover conveying unit 7N and the ejection opening 7H, back to the bookbinding apparatus B. The sheet S2 having entered the bookbinding apparatus B from the second receiving opening 7K is temporarily stored in the sheet S2 supply unit 5 so as to be reversed in terms of front-and-back sides. The sheet S2 is fed out again from the sheet S2 supply unit 5 and conveyed to the cutter 52 with guidance by the switching gate G1. The cutter 52 cuts off an unnecessary part (see FIG. 3) from the sheet S2, and then the sheet S2 is conveyed to the cover supporting unit 65 for bookbinding.

In the case of forming images only on the inside front cover 2 and inside back cover 3, the sheet S2 is conveyed to the conveying unit 7F without passing thorough the reverse conveying unit 7E. Images are formed on the inside front cover 2 and inside back cover 3 in the image forming unit, the images are heat-fixed, and then the sheet S2 is conveyed back to the bookbinding apparatus B. When the sheet S2 having entered the bookbinding apparatus B from the second receiving opening 7K is conveyed to the cutter 52 guided by the switching gate G1, the cutter 52 cuts off an unnecessary part (see FIG. 3) from the sheet S2, and then the sheet S2 is conveyed to the cover supporting unit 65 and for bookbinding.

In the case of forming images both on the inside and the back side of the cover, in other words, forming images on all of the four areas, the sheet S2 is revered by the reverse conveying unit 7E and then conveyed to the conveying unit 7F. After images are formed on the outside front cover 1 and outside back cover 4, the images are heat-fixed by the fixing unit 18, then the sheet S2 is conveyed, through the conveying-path switching plate 7D, to the reverse conveying unit 7E to be reversed in terms of front and back sides. Then, the sheet S2 is conveyed through the conveying unit 7F, and images are formed again on the inside front cover 2 and inside back cover 3 this time, then the sheet S2 is conveyed, through the fixing unit 18 and the conveying-path switching plate 7D, to the cover conveying unit 7N. The sheet S2 having entered the bookbinding apparatus B from the second receiving opening 7K is conveyed to the cutter 52 with guidance by the switching gate G1. The cutter 52 cuts off an unnecessary part of the sheet S2, and then the sheets S2 is conveyed to the cover supporting unit 65 for bookbinding.

Figure 2:
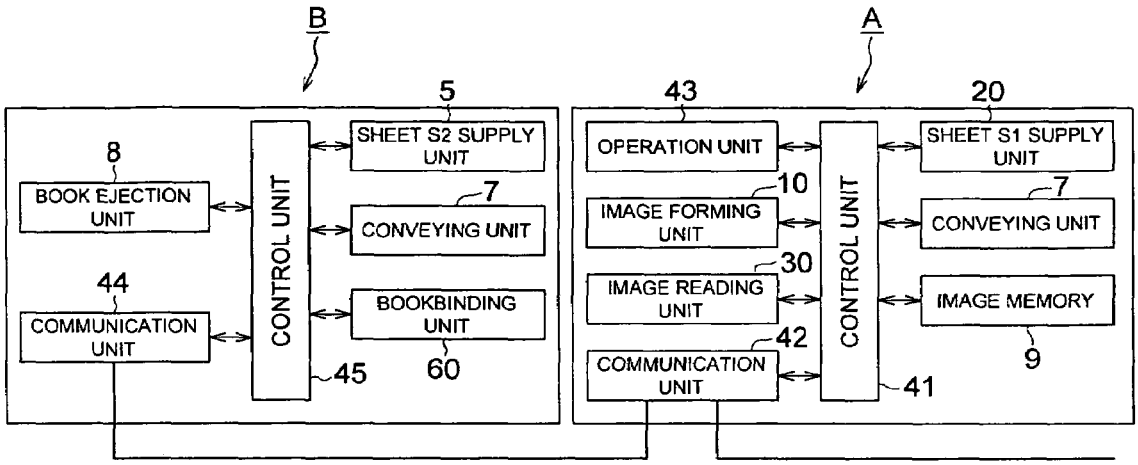
FIG. 2 is a block diagram of a bookbinding system in accordance with the embodiment of the invention.

FIG. 2 is a block diagram of the bookbinding system.

(Image Forming Apparatus A)

The sheet S1 supply unit 20 stores sheets S1 for inner pages, and sheets S1 are taken out one by one upon instruction from the control unit 41 and fed out to the conveying unit 7.

The conveying unit 7 conveys a sheet along a conveying-path shown in a heavy curve in FIG. 1.

The image forming unit 10 includes the charging unit 12, image exposing unit 13, developing unit 14, transferring unit 15, neutralizing unit 16, cleaning unit 17, and the like around the image carrier 11, and forms an image on a sheet, based on image data having been transmitted from an external device, such as a personal computer, or image data of an original document sheet having been read by the image reading unit 30.

The image reading unit 30 reads an image of an original document sheet having been conveyed by the original document sheet conveying device 31 or loaded on the original document sheet table 33 by the original document sheet reading unit 32, and generates an image signal.

The communication unit 42 communicates with a device on a network, such as a PC, receives an instruction for image forming transmitted from the network, and generates an image signal. Further, the communication unit 42 is connected with a communication unit 44 of the bookbinding apparatus B, and transmits an instruction for bookbinding or the like inputted via the operation unit.

The operation unit 43 is provided with a switch, LCD display and the like, not shown, and functions as a designating unit for input of information on sheets, setting of original document sheets for a cover in accordance with the present embodiment, and the like.

The control unit 41 includes a CPU (central processing unit), not shown, ROM storing a control program, RAM being a work memory, image memory 9 and others, and totally controls the respective units in the connected conveying unit 7, image forming unit 10 and the like. The image memory 9 stores image data having been read, upon instruction from the control unit 41.

(Bookbinding Apparatus B)

The sheet S2 supply unit 5 stores sheets S2 to be used for covers, and sheets S2 are taken out one by one upon instruction from the control unit 45 and fed out to the conveying unit 7.

The conveying unit 7 conveys a sheet along a conveying-paths shown in a heavy curve in FIG. 1.

A bookbinding unit 60 in FIG. 2 includes the stacking unit 63, coating unit 64, cutter 52, cover supporting unit 65 and others, and performs bookbinding with a bundle of sheets and a cover on which an image has been formed.

The control unit 45 includes a CPU (central processing unit), not shown, ROM storing a control program, RAM being a work memory and others, and totally controls the respective units in the connected conveying unit 7, bookbinding unit 60 and the like.

The communication unit 44 communicates with the image forming apparatus A and performs bookbinding of sheets on which an image has been formed, upon instruction for bookbinding.

Figure 3:
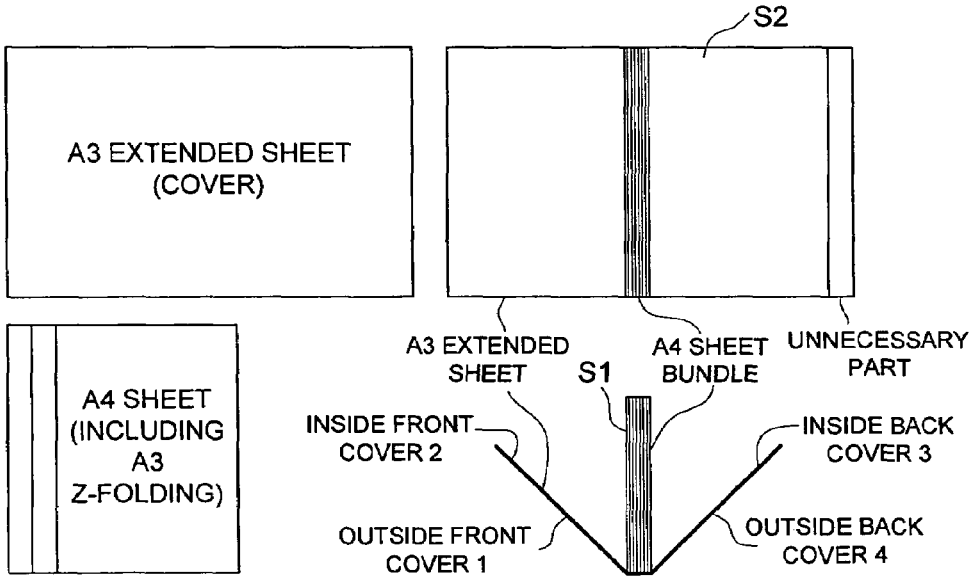
FIG. 3 is a schematic diagram showing an example of wrap-bookbinding.

FIG. 3 is a schematic diagram showing an example of wrap-bookbinding.

Bookbinding is illustrated where sheets in A4 size are used as sheets for inner pages and an extended sheet in A3 size is used for a cover. The bundle of sheets in A4 size is stuck with glue to the extended sheet in A3 size and wrapped for bookbinding. The thickness of the bundle of sheets in A4 size decides the size of the cover by the use of the extended sheet in A3 size. Images are formed on the cover, simultaneously on the outside front cover 1 and outside back cover 4, and simultaneously on the inside front cover 2 and inside back cover 3. After images are formed on the cover, an unnecessary part of the extended sheet in A3 size is cut off prior to bookbinding.

Figure 4:
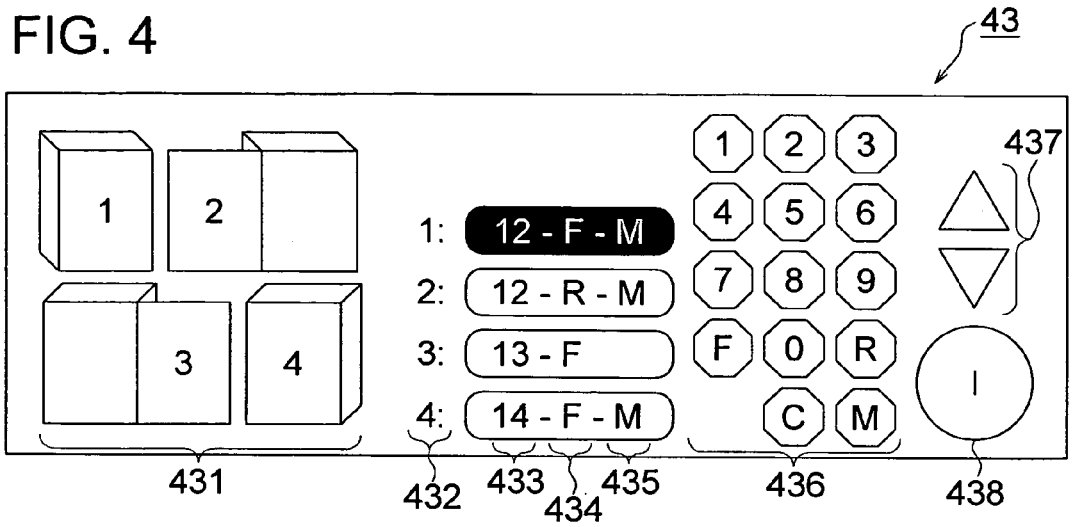
FIG. 4 is a schematic diagram showing an operation unit to designate original document sheets with images to be formed on a cover, in accordance with embodiment of the invention.

FIG. 4 is a schematic diagram showing the operation unit 43 for designation of original document sheets based upon which images are formed on the cover.

Herein, a touch-panel type LCD is shown as an example.

Numeral 431 represents a display of the state of bookbinding on a LCD, wherein an outside front cover 1, inside front cover 2, inside back cover 3, and outside back cover 4 are shown.

Numeral 432 represents indications of the numbers from 1 for the outside front cover to 4 for the outside back cover, corresponding to the positions on a cover shown by the display 431.

Numerals 436 to 438 represent input buttons, and numerals 433 to 435 represent indicators for indication of the states where information on the respective original document sheets for image forming on the cover is set.

Triangle buttons 437 are selection buttons to set one of the positions on the cover represented by numbers 1 to 4 which are indicated by the indicator 432, wherein a selected position on the cover can be input. Information by one of the indicators 433 to 435 of a selected number may be black-and-white highlighted or blinked. For example, information on the outside front cover 1 is black-and-white highlighted in FIG. 4.

Numeral 436 represents input buttons for setting. The number buttons are used to designate the sheet numbers of original document sheets read by the image reading unit 30 to be used for the cover.

Button F is used to designate the front side of an original document sheet to be read, and button R is used to designate the rear side (back side).

Button M is used for an original document sheet dedicated to a cover. With an original document sheet for which button M is not input, the same image can be formed on both a sheet for a cover and a sheet for an inner page.

Button C is a clear button to clear an input.

Numeral 438 represents a confirmation button for confirmation of an input in such a manner that this confirmation button is pressed after an input of a number, for example. After confirmation, information indicated by the indicators 433 to 435 is transmitted to the control unit 41. When the position on the cover is changed with a triangle button after an input of a number or the like without pressing the confirmation button following the input, the indication returns to the state before the input of the number or the like.

The number represented by numeral 433 indicates the sheet number of an original document sheet to be read by the image reading unit 30. For example, number '12' indicates the original document sheet which is read 12th. The number represented by numeral 434 indicates designation of which of the front and rear sides of an original document sheet indicated by the number represented by 433 is to be used. F represents the front side and R represents the rear side. The number represented by numeral 435 indicates designation whether a designated original document sheet is to be used for a cover only or also for a sheet for an inner page of a book. Herein, M represents designation of a usage for a cover only, and no indication represents designation of a usage for both a cover and inner page.

For example, '12-F-M' is indicated for position 1 on the cover. This means that an image is to be formed on the outside front cover 1, based on the front side of the 12th original document sheet. Further, it means that the designated original document sheet is used for a cover only and not used for an inner page.

For position 2 on the cover, '12-R-M' is indicated. This means that an image is to be formed on the inside front cover 2, based on the rear side of the 12th original document sheet. Further, it means that the designated document is used for the cover only and not used for an inner page.

For the cover position 3, '13-F' is indicated. This means that an image is formed on the inside back cover 3 and on an inner page as well, based on the front side of the 13th original document sheet. That is, since M is not designated, the original document sheet is used also for an inner page.

For the cover position 4, '14-F-M' is indicated. This means that an image is to be formed on the outside front cover 4, based on the front side of the 14th original document sheet. Further, it means that the designated document is used for the cover only and not used for an inner page.

With the operations described above, it is possible to form an image on both a cover and an inner page, based on a designated original document sheet, and it is not necessary to read the same original document sheet twice, which achieves reduction of working time.

Further, since it is possible to use an arbitrary portion of image data of original document sheets having been read, for image forming on a cover, the necessity to adjust the order of reading original document sheets in advance is eliminated, which further reduces the working time.

Still further, since the state of bookbinding is displayed in advance, mistakes in bookbinding can be prevented.

Figure 5:
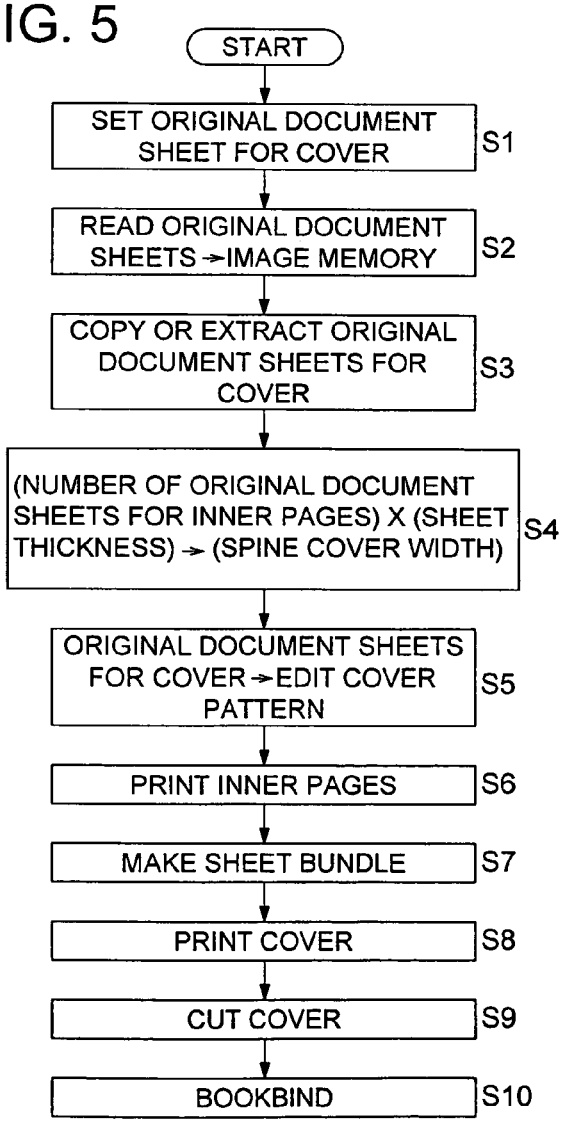
FIG. 5 is an example of a flowchart showing the flow of operations from image reading to bookbinding, in accordance with the embodiment of the invention.

FIG. 5 is an example of a flowchart showing the flow of operations from image reading to bookbinding.

In step S1, information on original document sheets for a cover is set by the method using the operation unit 43, as having been described referring to FIG. 4. Information having been set is transmitted to the control unit 41.

In step S2, original document sheets are read by the image reading unit 30, and thus obtained image data is sequentially stored in the image memory 9 by the control unit 41.

In step S3, image data for image forming on a cover is copied or extracted from the image data stored in the image memory, based on the information having been set in step S1.

In step S4, the thickness of a sheet for an inner page multiplied by the number of original document sheets for inner pages is applied to the width of the spine cover.

In step S5, the size of the cover is decided, according to the width of a sheet for an inner page and the width of the spine cover calculated in step S4. An area for the cover is arranged in the image memory, and the image data for the cover copied or extracted in step S3 is allocated to the area for the cover so that a cover pattern is edited.

In step S6, the image data for inner pages stored in the image memory is used to form images on sheets for inner pages.

In step S7, the sheets for inner pages on which an image has been formed are made into a bundle of sheets.

In step S8, the cover pattern edited in step S5 is used to form images on a sheet for a cover.

In step S9, an unnecessary part of the sheet for the cover is cut off, images having been formed on the cover.

In step S10, the bundle of sheets and the sheet for the cover are bound into a book.

The detailed structures and operations of the respective structures that construct the image forming apparatus, bookbinding apparatus, and bookbinding system can be modified within the scope of the spirit of the invention.

What is claimed is:

1. An image forming apparatus that forms an image on a sheet, comprising:

a reading unit that reads a plurality of original document sheets;

a supply unit that supplies a sheet for a cover and a sheet for an inner page;

a designating unit for designating an original document sheet from the plurality of original document sheets to be read by the reading unit;

an image forming unit that forms an image based on information on a read original document; and a control unit that controls selection of a sheet, wherein, the designating unit comprises a setting input section which designates an original document sheet for forming an image only on a sheet for a cover and designates an original document sheet for forming an image both on a sheet for a cover and on a sheet for an inner page, and the control unit performs control to supply a sheet for a cover from the supply unit when an image is formed based on an original document sheet designated by the designating unit, and to supply a sheet for an inner page from the supply unit when an image is formed based on an original document sheet not designated by the designating unit, and when an original document sheet is designated for forming an image only on a sheet for a cover, the control unit performs control to supply a sheet for a cover from the supply unit and to form an image only on the sheet for the cover based on the designated original document sheet, and when an original document sheet is designated for forming an image both on a sheet for a cover and on a sheet for an inner page, the control unit performs control to supply a sheet for a cover from the supply unit and to form an image on the sheet for the cover based on the designated original document sheet, as well as performs control to supply a sheet for an inner page from the supply unit and to form an image on the sheet for the inner page based on the same designated original document sheet.

2. The image forming apparatus of claim 1, wherein the control unit performs control to form an image based on an original document sheet designated by the designating unit at an arbitrary position on a sheet for a cover.

3. The image forming apparatus of claim 1, wherein the control unit performs control to display in advance a state of bookbinding by a use of sheets on which an image has been formed by the image forming apparatus.

4. The image forming apparatus of claim 1, further comprising a display unit that displays a state of bookbinding by a use of sheets on which an image has been formed by the image forming apparatus.

5. The image forming apparatus of claim 1, wherein an original document sheet for image forming for a cover is designated from read original document sheets via the designating unit.

6. A bookbinding system, comprising:

an image forming apparatus including a reading unit that reads a plurality of original document sheets and an image forming unit that forms an image on a sheet based on information on a read original document sheet;

a bookbinding apparatus that binds sheets on which an image has been formed by the image forming apparatus into a book;

a supply unit that supplies a sheet for a cover and a sheet for an inner page;

a designating unit for designating an original document sheet from the plurality of original document sheets to be read by the reading unit; and a control unit that controls selection of a sheet, wherein, the designating unit comprises a set input section which designates an original document sheet for forming an image only on a sheet for a cover and designates an original document sheet for forming an image both on a sheet for a cover and on a sheet for an inner page, and the control unit performs control to supply a sheet for a cover from the supply unit when an image is formed based on an original document sheet designated by the designating unit, and to supply a sheet for an inner page from the supply unit when an image is formed based on an original document sheet not designated by the designating unit, and, when an original document sheet is designated for forming an image only on a sheet for a cover, the control unit performs control to supply a sheet for a cover from the supply unit and to form an image on the sheet for the cover based on the designated original document sheet and, when an original document sheet is designated for forming an image both on a sheet for a cover and on a sheet for an inner page, the control unit performs control to supply a sheet for a cover from the supply unit and to form an image on the sheet for the cover based on the designated original document sheet, as well as performs control to supply a sheet for an inner page from the supply unit and to form an image on the sheet for the inner page based on the same designated original document sheet.

7. The bookbinding system of claim 6, wherein the control unit performs control to form an image at an arbitrary position on a sheet for a cover, based on an original document sheet designated by the designating unit.

8. The bookbinding system of claim 6, wherein the control unit performs control to display in advance a state of bookbinding by the bookbinding system.

9. The bookbinding system of claim 6, wherein an original document sheet for image forming for a cover is designated from read original document sheets via the designating unit.

10. The bookbinding system of claim 6, further comprising a display unit that displays a state of bookbinding by a use of sheets on which an image has been formed by the image forming apparatus.

11. An image forming method, comprising steps of:

reading a plurality of original document sheets;

designating an original document sheet from the plurality of original document sheets to be read;

supplying a sheet for a cover, when an image is formed based on an designated original document sheet;

supplying a sheet for an inner page, when an image is formed based on an original document sheet that is not designated;

forming an image on a supplied sheet based on an original document sheet having been read;

setting designating an original document sheet based on which an image is to be formed on a sheet for a cover and designating an original document sheet based on which an image is to be formed both on a sheet for a cover and on a sheet for an inner page;

when an original document sheet is designated for forming an image only on a sheet for a cover, supplying a sheet for a cover from the supply unit and forming an image on the sheet for the cover based on the designated original document sheet;

and when an original document sheet is designated for forming an image both on a sheet for a cover and on a sheet for an inner page. supplying a sheet for a cover from the supply unit and forming an image on the sheet for the cover based on the designated original document sheet as well as supplying a sheet for an inner page from the supply unit and forming an image on the sheet for the inner page based on the same designated original document sheet.

* * * * *